United States Patent [19]

Heidsiek et al.

[11] Patent Number: 4,579,787

[45] Date of Patent: Apr. 1, 1986

[54] MATERIAL FOR LOW VOLTAGE CURRENT CONTACTS

[75] Inventors: Horst Heidsiek, Jalan Kilang Timor; Hartmuth Schmidt, Ostercappeln, both of Fed. Rep. of Germany

[73] Assignee: Degussa Aktiengesellschaft, Frankfurt am Main, Fed. Rep. of Germany

[21] Appl. No.: 678,975

[22] Filed: Dec. 6, 1984

[30] Foreign Application Priority Data

Dec. 14, 1983 [DE] Fed. Rep. of Germany ..... 3345162

[51] Int. Cl.[4] ..... C22C 30/00

[52] U.S. Cl. ..... 428/670; 928/929; 470/463; 470/580; 470/589; 200/266; 339/278 C

[58] Field of Search ..... 420/580, 463, 501, 505, 420/508, 511; 428/929, 670; 339/278 C; 200/265, 266

[56] References Cited

U.S. PATENT DOCUMENTS

| | | | |
|---|---|---|---|
| 1,248,621 | 12/1917 | Cooper | 420/505 |
| 2,154,068 | 4/1939 | Ellis | 420/501 |
| 2,241,262 | 5/1941 | Keitel | 420/505 |
| 2,300,286 | 10/1943 | Gwyn, Jr. | 420/580 |
| 2,418,710 | 4/1947 | Hensel | 420/463 |
| 3,981,724 | 9/1976 | Prasad | 420/505 |
| 4,069,370 | 1/1978 | Harmsen et al. | 420/580 |

FOREIGN PATENT DOCUMENTS

| | | | |
|---|---|---|---|
| 1089491 | 9/1960 | Fed. Rep. of Germany | 420/580 |
| 2637807 | 2/1978 | Fed. Rep. of Germany . | |
| 2940772 | 4/1981 | Fed. Rep. of Germany . | |
| 3146794 | 6/1983 | Fed. Rep. of Germany | 420/463 |

OTHER PUBLICATIONS

Russell R. J. "Properties of Inlay Clad Brought Gold Alloys" Solid State Technology Aug., 1976 pp. 39–48.

*Primary Examiner*—Christopher W. Brody
*Attorney, Agent, or Firm*—Cushman, Darby & Cushman

[57] ABSTRACT

Low voltage current contacts should have good tarnish resistance and resistance to wear at the smallest possible gold content. Such materials consist of 330 to 50 wt. % palladium, 18 to 48 wt. % silver, 19 to 33 wt. % gold, 0.01 to 1 wt. % iridium, osmium, or a mixture of iridium and osmium and either 0.5 to 5 wt. % lead or a mixture of 0.5 to 3 wt. % lead and 0.1 to 3 wt. % tin.

10 Claims, No Drawings

MATERIAL FOR LOW VOLTAGE CURRENT CONTACTS

BACKGROUND OF THE INVENTION

The invention is directed to material for low voltage current contacts, especially for separable connectors and slide contacts which are applied in a thin layer over a nickel intermediate layer to a carrier made of a base metal.

Separable connectors are present to a considerable extent in electronic apparatus. They guarantee safe contact and quick changing of defective structural units. With advancing efficiency of electronic apparatus, the requirements as to the quality of the work material of this type of connectors have changed. While a few years ago in part considerable electrical loads flowed over the contacts, today frequently only very small currents and voltage are carried, in the micro and nano region. Furthermore, on the one hand, the increasing miniaturization of the structural parts and therewith also the connectors and on the other hand the increasing air pollution have intensified to a considerable extent the problem of tarnish resistance of the contacts employed. While previously tarnish films perhaps present on the contact pieces were easily destroyed because of the applied voltages through so-called fitting or could be broken mechanically without trouble through the high contact forces, the voltages or the considerably reduced contact forces through the increasing miniaturization are no longer sufficient for this type of self-purification. The resistance to formation of tarnish films which are frequently not visible optically, therefore, has become the most important criterium of modern contact materials.

Besides a good resistance to film formation, the contact material must also have a good resistance to wear. While in earlier years low voltage current contacts were made massive or the corresponding materials were employed at least in thick layers, the price development of the noble metals forced the employment of continually thinner layers up to layer thicknesses of 1$\mu$ and less. The material for such thin layer, therefore, must have an especial resistance to wear.

Generally, by alloying base metals to noble metals there can to be sure improved the resistance to wear of materials, but there is increased thereby the tendency to form tarnish films. On the other hand, tarnishing resistant materials normally exhibit poor resistance to wear.

Naturally, alloys having a high gold content can fulfill the requirements in regard to film formation. Thereby, there have proven good especially alloys of gold and silver having more than 70 wt. % gold. There are also known high carat alloys which in addition to gold and silver also contain copper and/or nickel, but even these alloys despite their high gold content are frequently not sufficiently resistant to corrosion, since the copper has a tendency both to form the sulfide and the oxide. Furthermore, the high gold content is a considerable economic disadvantage in view of the high price of gold.

There are known from German OS No. 2637807 and German OS No. 2940772 contact materials on a basis of gold-silver-palladium, which are distinguished by a good tarnish resistance while at the same time having a reduced gold content. Besides gold-silver-palladium, they also contain several percent of base metals, such as copper, nickel, indium, and tin. Thereby, in these work-pieces there were always needed a gold portion of more than 35 wt. % which previously was regarded as the lowest limit for a sufficient resistance of such contact materials to formation of tarnish films. Besides the resistance to wear of these materials is still not optimium.

Low gold contact materials for low voltage current contacts are known from German Pat. No. 1089491. These contain 25 to 35 wt. % gold, 35 to 45 wt. % silver, and 25 to 35 wt. % palladium. These materials, however, likewise form films with the injurious loadings in the air today and besides they are not resistant to wear.

Therefore, it was the problem of the present invention to develop materials for low voltage current contacts, especially for separable connectors and slide contacts which are applied in a thin layer over a nickel intermediate layer to a carrier made of a base metal material and which have a good tarnish resistance and good resistance to wear at the lowest possible gold content. Besides, they should be well applied to the carrier material and show no increase in the contact resistance even with long storage at temperatures of 125° C.

SUMMARY OF THE INVENTION

This problem was solved according to the invention by a composition which contains 33 to 50 wt. % palladium, 18 to 48 wt. % silver, 19 to 33 wt. % gold, 0.01 to 1 wt. % iridium, osmium, or a mixture of iridium and osmium and either 0.5 to 5 wt. % lead or a mixture of 0.5 to 3 wt. % lead and 0.1 to 3 wt. % tin.

Preferably, the material contains 33 to 45 wt. % palladium, 25 to 40 wt. % silver, 20 to 30 wt. % gold, 0.01 to 1 wt. % iridium, osmium, or a mixture of iridium and osmium and either 0.5 to 4 wt. % lead or 0.5 to 2 wt. % lead and 0.2 to 2 wt. % tin.

These materials unexpectedly show very good tarnish resistance, i.e., they are resistant to formation of corrosive films, in spite of a gold content below 33 wt. %, possess a very high resistance to wear and experience no increase in the electrical contact resistance with long storage at 125° C. Besides, they can be readily plated on base metal carriers having a nickel intermediate layer.

The compositions can consist essentially of or consist of the stated materials.

Unless otherwise indicated, all parts and percentages are by weight.

The following examples of alloy composition show these favorable properties.

Compositions (a) 33.7% Pd, 44.6% Ag, 20.0% Au, 0.05% Ir, 1.65% Pb
(b) 33.3% Pd, 33.8% Ag, 29.6% Au, 0.05% Os, 3.25% Pb
(c) 33.7% Pd, 34.2% Ag, 29.9% Au, 0.05% Ir, 1.65% Pb, 0.5% Sn
(d) 43.1% Pd, 33.1% Ag, 21.1% Au, 0.05% Os, 1.25% Pb, 1.4% Sn
(e) 39.1% Pd, 30.6% Ag, 28.5% Au, 0.05% Os, 0.8% Pb, 0.95% Sn
(f) 42.8% Pd, 27.7% Ag, 27.0% Au, 0.05% Ir, 2.45% Pb
(g) 46.1% Pd, 23.2% Ag, 28.5% Au, 0.05% Os, 1.65% Pb, 0.5% Sn The contacts are fabricated by cladding. Thereby the contact materials according (a) to (g) and nickel and placed as a strip onto the base metal substrate, e.g. copper, by a compression bonding step. The compression bonding is preferrably a cold rolling process with a reduction of thickness of typically 60%.

The compression bonding is followed by a annealing treatment which allows to improve the bonding strength by diffusion. Typical annealing temperatures are in the range 600°-800° C. The desired thickness of the clad material and its spring characteristics are obtained by a final cold rolling step.

What is claimed is:

1. A material suitable for use as a low voltage current contact which can be applied to a carrier made of a base metal over a nickel intermediate layer consisting essentially of 33 to 50 wt. % palladium, 18 to 48 wt. % silver, 19 to 33 wt. % gold, 0.01 to 1 wt. % iridium, osmium or a mixture of iridium and osmium and either 0.5 to 5 wt. % lead or a mixture of 0.5 to 3 wt. % lead and 0.1 to 3 wt. % tin.

2. A material according to claim 1 consisting essentially of 33 to 45 wt. % palladium, 25 to 40 wt. % silver, 20 to 30 wt. % gold, 0.01 to 1 wt. % iridium, osmium, or a mixture of iridium and osmium and either 0.5 to 4 wt. % lead or 0.5 to 2 wt. % lead and 0.2 to 2 wt. % tin.

3. A low voltage current contact comprising a base metal layer, a nickel intermediate layer, and an outer layer of the material of claim 1.

4. A contact according to claim 3 which is a separable electric connector.

5. A contact according to claim 3 which is a slide contact.

6. A low voltage current contact comprising a base metal layer, a nickel intermediate layer, and an outer layer of the material of claim 2.

7. A contact according to claim 6 which is a separable electric connector.

8. A contact according to claim 6 which is a slide contact.

9. A low voltage contact comprising a layer of the material of claim 1, said layer having good tarnish resistance and good resistance to wear.

10. A low voltage contact comprising a layer of the material of claim 2, said layer having good tarnish resistance and good resistance to wear.

* * * * *